US006056418A

United States Patent [19]

Hsu

[11] Patent Number: 6,056,418

[45] Date of Patent: May 2, 2000

[54] PATTERN FRAME TYPE DECORATIVE LAMP STRING WITH ATTACHABLE POSITIONING MEMBERS

[76] Inventor: Chao-Ming Hsu, No.3, Alley 3, Lane 620, Chiung Kuo Rd., Sec.2, Hsinchu City, Taiwan

[21] Appl. No.: 08/859,467

[22] Filed: May 19, 1997

[51] Int. Cl.[7] ..... F21V 21/00

[52] U.S. Cl. ..... 362/249; 362/250; 362/252; 362/396; 362/382; 362/806

[58] Field of Search ..... 362/249, 250, 362/252, 416, 391, 396, 806, 382, 239, 2

[56] References Cited

U.S. PATENT DOCUMENTS 5,526,246 6/1996 Liou ..... 362/252
5,727,872 3/1998 Liou ..... 362/252

*Primary Examiner*—Sandra O'Shea
*Assistant Examiner*—John A Ward
*Attorney, Agent, or Firm*—Rosenberg, Klein & Lee

[57] ABSTRACT

The present invention relates to a pattern frame type decorative lamp string, and more particularly to a pattern frame type decorative lamp string with attachable positioning members. The attachable positioning member has an upper circular arc part for holding a lamp socket of a lamp string, and has a pair of flexible jaws at a lower part thereof for mounting movably on any position of the pattern frame.

4 Claims, 4 Drawing Sheets

PATTERN FRAME TYPE DECORATIVE LAMP STRING WITH ATTACHABLE POSITIONING MEMBERS

FIELD OF THE INVENTION

The present invention relates to a pattern frame type decorative lamp string, and more particularly to a pattern frame type decorative lamp string with attachable positioning members.

BACKGROUND OF THE INVENTION

The decorative lamp string innovates from C-type lamp string to peppertype lamp string, and from bare lamp string to pattern frame type lamp string. The pattern frame type lamp strings currently available in the market have many different types, but basically the pattren frame is a strip type provided with a plurality of fixed positioning members. The positioning member forms two fastening jaws entended upwardly from the pattern frame for holding a lamp socket. Since the positioning members and the pattern frame are integrally moulded with plastics, the decorative effect is therefore fixed without varieties.

OBJECT OF THE INVENTION

It is therefore an object of the present invention to provide a pattern frame type decorative lamp string with attachable positioning member; so that a user can create different patterns with one certian type of pattern frames for decorating a Christmas tree.

BRIEF DESCRIPTION OF THE DRAWINGS

The present invention can be better understood by detailed descriptions of the following drawings, in which.

DETAILED DESCRIPTION OF THE INVENTION

Figure 1:
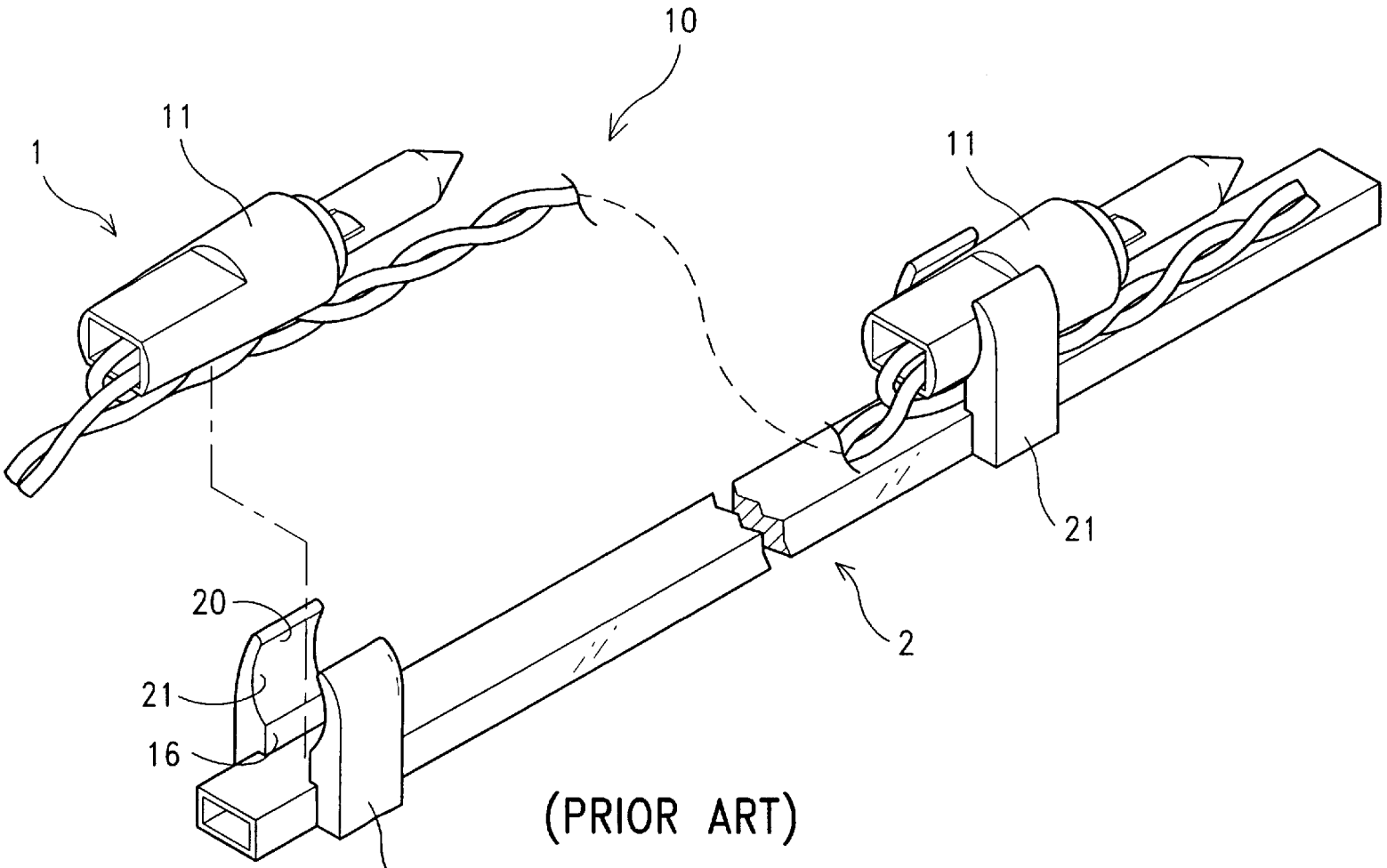
(PRIOR ART) FIG. 1
FIG. 1 is a schematic diagram showing that the positioning jaw 21 for holding the lamp socket 11 of the lamp string 1 according to a conventional pattern frame type decorative lamp string is integrally moulded with the pattern frame.
Figure 2:
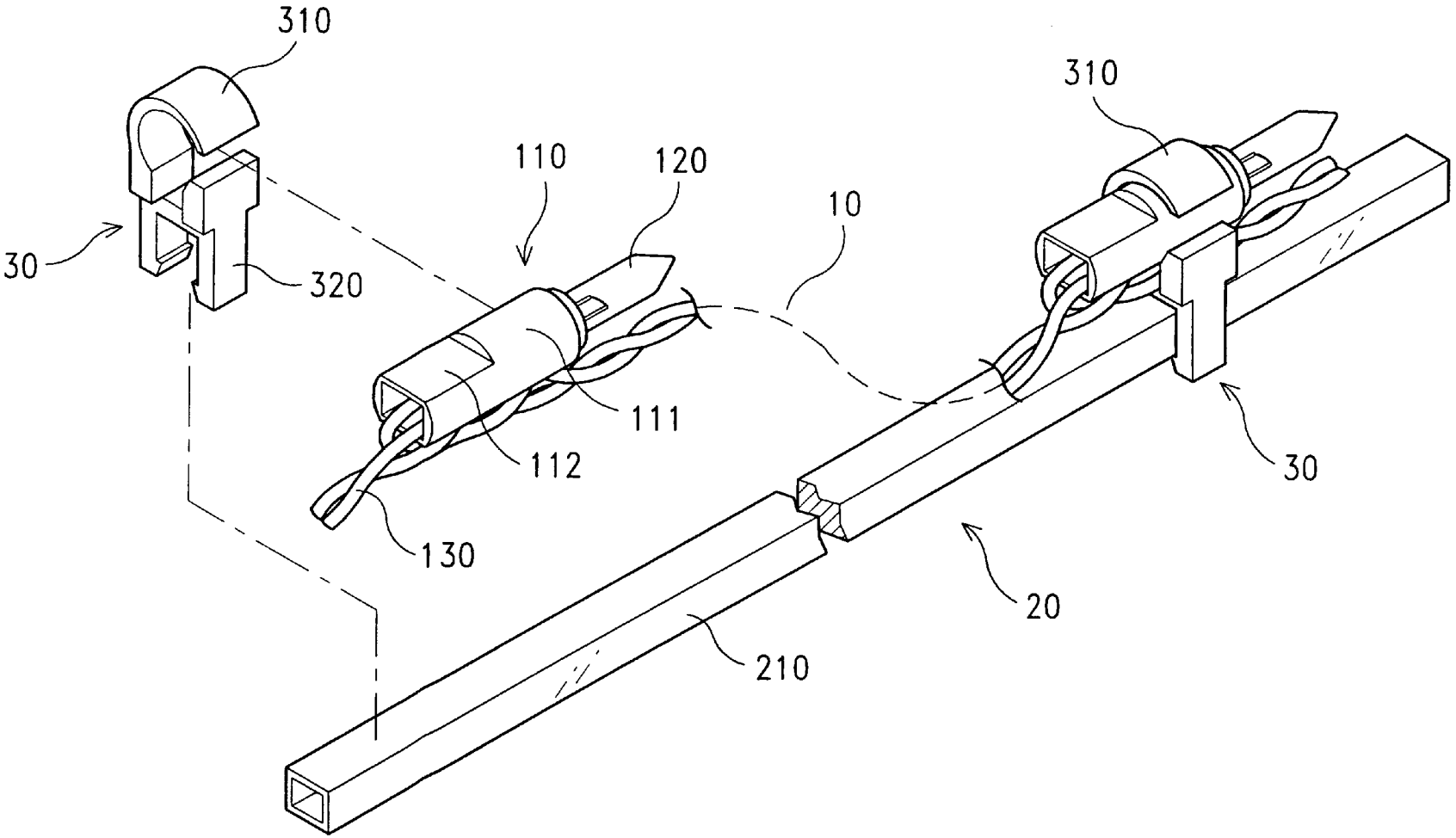
FIG. 2 is schematic diagram showing that an attachable positioning member is movably attached on the pattern frame according to the present invention.
Figure 3B:
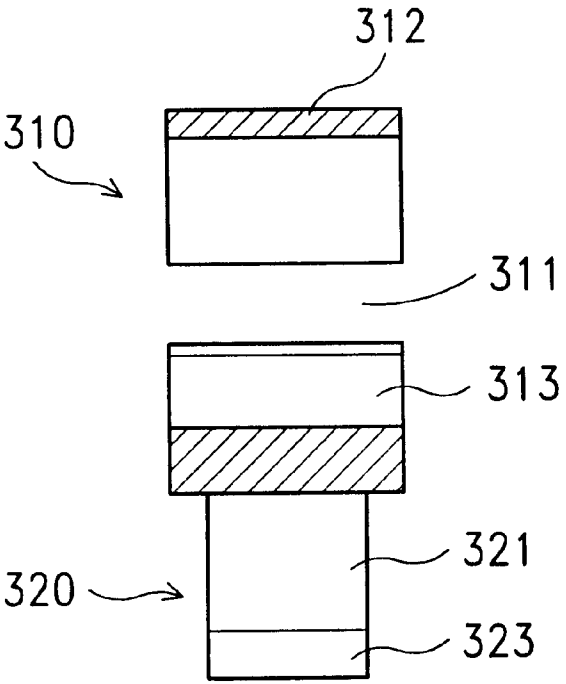
FIGS. 3A and 3B are respectively front view and side view of an embodiment of the attachable positioning member according to the present invention.
Figure 3A:
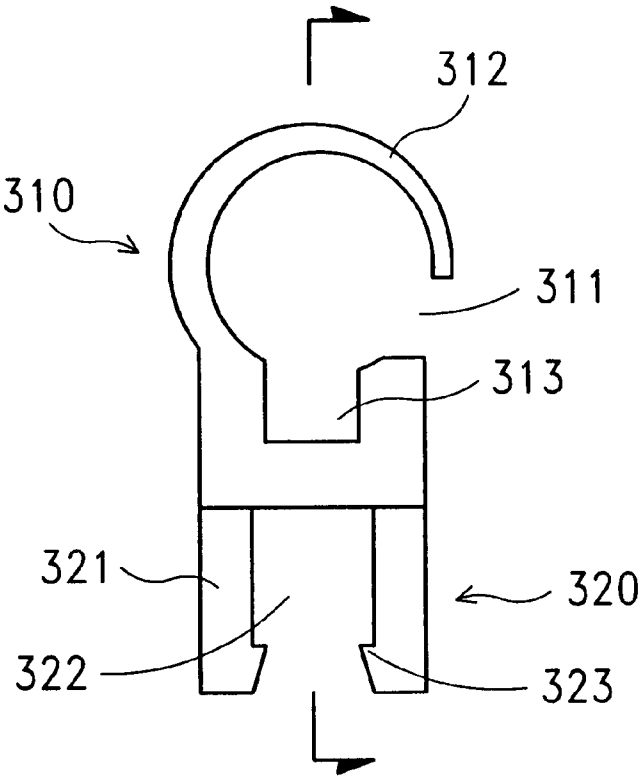

Please refer to FIG. 2 (and compare with FIG. 1), a lamp string 10 comprises a lamp socket 110, a lamp 120 and conducting wires 130 wherein a front end of the lamp socket 110 is a cylindrical body 111, a back end thereof is partially reduced by two oposite parallel walls 112; a pattern frame 20 is formed by winding a thin strip 210 of rectangular section around; a attachable positioning member 30 having an upper circular arc part 310 for holding the cylindrical body 111 of the front end of the lamp socket 110, and having a lower part 320 with flexible jaws 321 for mounting movably on any position of the strip 210, so that different decorative patterns can be designed according to the user's idea;

Please refer to FIGS. 3A and 3B, which shows that a movable positioning member 30 of a preferred embodiment of the present invention is injection moulded by plastics, and comprises an upper circular arc part 310 having a diameter slightly less than that of the cylindrical body 111 of the lamp socket 110 for holding the lamp socket 110 tightly. An opening 311 is provided at one side of the circular arc part 310 to form an arc end 312. The width of said opening 311 is slightly wider than the thickness between two parallel walls 112 of the reduced back end of the lamp socket 110 so that the lamp socket 110 can be easily pushed into the circular arc part 310. A recess 313 is disposed to a bottom within the circular arc part 310 for passing through at least two wires 130 of the lamp string 10. The lower part 320 is provided with a pair of downward flexible jaws 321 building up a rectangular space 322 therebetween for accommodating the strip 210. An inward slide-in hook 323 disposed to each lower end of the jaws 321 such that the strip 210 can be easily pushed into but difficult to be pulled out.

Figure 4B:
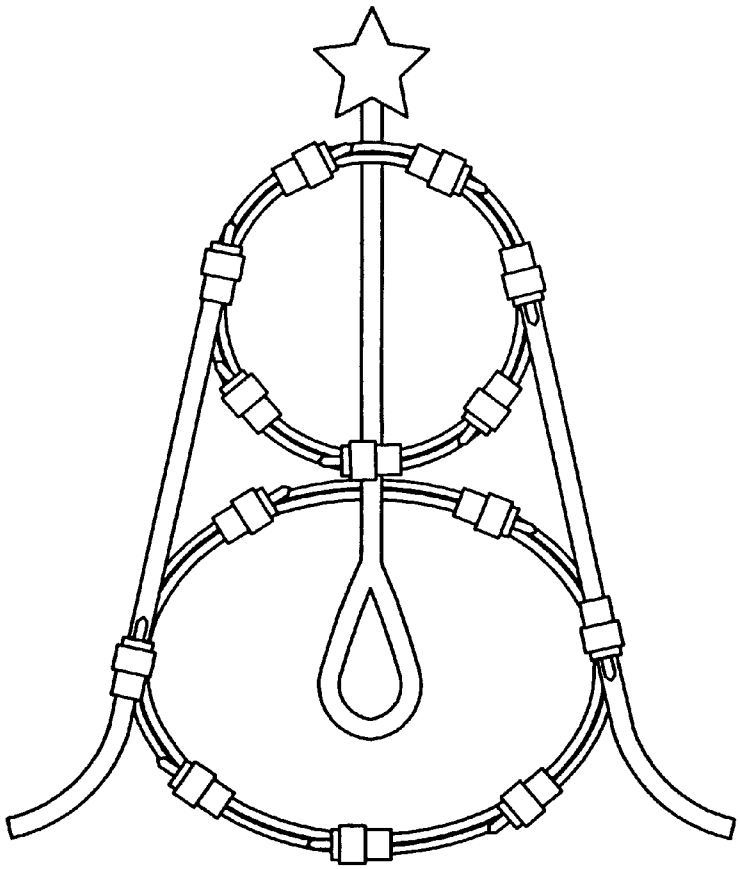
FIGS. 4A and 4B showing an example of an embodiment according to the present invention that the attachable positioning members are arranged at different positions on two same type of pattern frame to make two different decorative patterns.
Figure 4A:
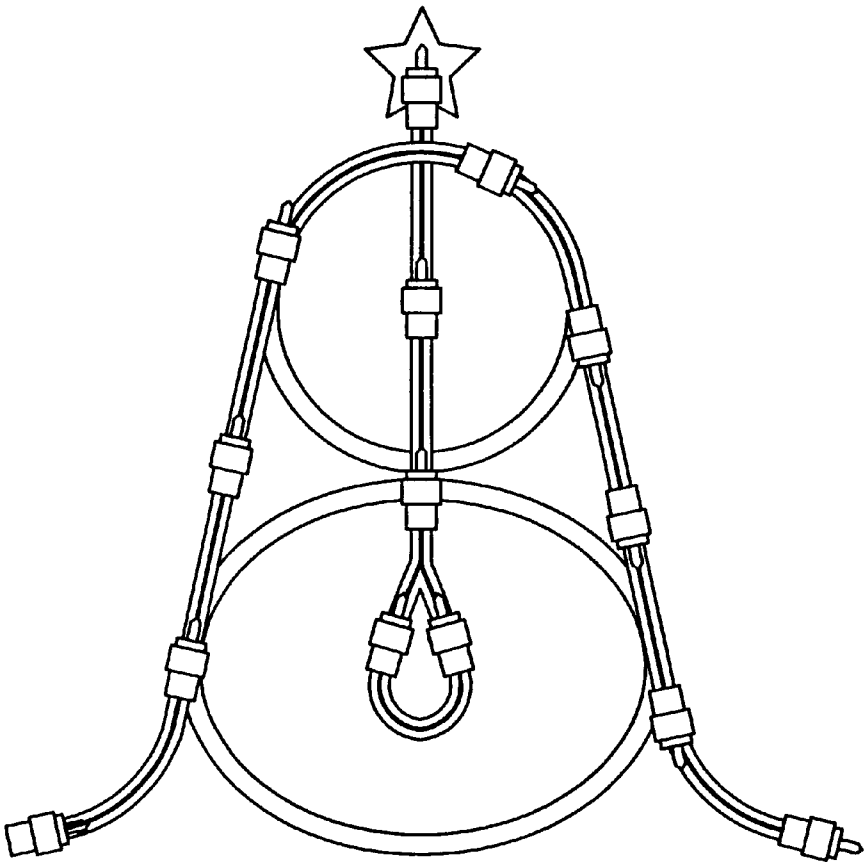

Please refer to FIGS. 4A and 4B, wherein the same type of pattern frame 20 and lamp string 10 are shown in the figures, but two sets of plurality of attachable positioning members 30 are disposed differently to form different patterns.

It is no doubt that after reading the above descriptions any skillful person in the art can creat many different variations without departing the spirit and scope of the accompanying claims. Therefore, it is intended that the appended claims will cover all those variations.

What is claimed is:

1. A decorative lamp string, comprising:

a plurality of lamps coupled in a lamp string, each lamp being mounted on a socket having a cylindrical front body of a first diameter and a back body, said back body having two opposite parallel walls defining therebetween a width of said back body of said socket, said width of said back body being smaller than said first diameter of said cylindrical front body of said socket;

a pattern frame including a strip laid-out in a desired contour, said strip being substantially rectangular in cross-section contour;

a pair of conducting wires passing longitudinally from said socket between said parallel walls of said back body thereof; and a plurality of positioning members selectably positionable on said pattern frame, each said positioning member including a lower part adapted for removably attaching said positioning member to said strip of said pattern frame, and further including an upper part having a socket receiving opening for removably attaching said socket of a respective lamp thereto, said lower and upper parts being joined together over a transversely extending member of said positioning member, said lower part of said positioning member including a pair of spaced flexible jaws extending downwardly from said transversely extending member of said positioning member and forming therebetween a substantially rectangularly shaped opening for snugly receiving said strip therein, thus movably securing said positioning member to said strip, each said flexible jaw having an inwardly extending hook portion at a lower end thereof for engaging said pattern frame, and said upper part of said positioning member including an upper circular arc portion formed by an extended wall circumscribing a substantial portion of socket receiving opening, said extended wall having a first end thereof coupled to one end of said transversely extending member and a second end disposed in spaced relationship with an opposing end of said transversely extending member, thereby defining a side opening in open communication with said socket receiving opening disposed between said second end of said extended wall said transversely extending member for displacing said socket into said socket receiving opening.

2. A pattern frame type decorative lamp string with attachable positioning members according to claim 1, wherein said socket receiving opening of said positioning member has a second diameter smaller than said first diameter of said cylindrical body of said socket.

3. A pattern frame type decorative lamp string with attachable positioning members according to claim 1, wherein said side opening has a width thereof larger than said width of said back body defined between said two parallel walls thereof.

4. A pattern frame type decorative lamp string with attachable positioning members according to claim 1, wherein a recess is formed within said circular arc portion between said opposing ends of said transversely extending member, said conductive wires passing through said recess.

* * * * *